US007900570B2

(12) United States Patent
Chiu

(10) Patent No.: US 7,900,570 B2
(45) Date of Patent: Mar. 8, 2011

(54) ROLL MOTION DAMPING DEVICE FOR A FLOATING BODY

(75) Inventor: Hin Chiu, Sugar Land, TX (US)

(73) Assignee: Zentech, Inc., Houston, TX (US)

( * ) Notice: Subject to any disclaimer, the term of this patent is extended or adjusted under 35 U.S.C. 154(b) by 0 days.

(21) Appl. No.: 12/357,290

(22) Filed: Jan. 21, 2009

(65) Prior Publication Data

US 2009/0120342 A1 May 14, 2009

Related U.S. Application Data

(63) Continuation of application No. 11/466,747, filed on Aug. 23, 2006, now Pat. No. 7,500,440.

(60) Provisional application No. 60/763,293, filed on Jan. 30, 2006.

(51) Int. Cl.
*B63B 41/00* (2006.01)

(52) U.S. Cl. ..... 114/143; 114/121; 114/122

(58) Field of Classification Search ..... 114/121, 114/122, 125, 126, 140, 143, 284
See application file for complete search history.

(56) References Cited

U.S. PATENT DOCUMENTS

| | | | | |
|---|---|---|---|---|
| 968,927 | A | 8/1910 | Frahm | |
| 3,299,846 | A | 1/1967 | Jarlan | |
| 3,481,296 | A | 12/1969 | Stephens | |
| 3,513,797 | A * | 5/1970 | Frankel | 114/125 |
| 4,232,623 | A | 11/1980 | Chou et al. | |
| 4,261,277 | A | 4/1981 | Bergman | |
| 6,651,579 | B1 | 11/2003 | Wynne et al. | |
| 7,500,440 | B2 * | 3/2009 | Chiu | 114/143 |

OTHER PUBLICATIONS

PCT/US07/61236, Search Report and Written Opinion of International Searching Authority dated Dec. 14, 2007.

* cited by examiner

*Primary Examiner* — Lars A Olson
(74) *Attorney, Agent, or Firm* — Baker & McKenzie LLP

(57) ABSTRACT

The present disclosure relates to techniques for reducing roll motion experienced by a floating vessel. The disclosure reveals several different techniques for damping roll motion, which may be used alone or in conjunction to stabilize a floating vessel. A typical disclosed embodiment of a roll motion damping device would employ a sponson on each side of the vessel. Each sponson would typically encompass one or more baffles. And a wing keel could be located on the outside of each sponson. When all of these features are used in conjunction, they work synergistically to maximize the resistance to roll experienced by the floating vessel.

20 Claims, 3 Drawing Sheets

ROLL MOTION DAMPING DEVICE FOR A FLOATING BODY

CROSS-REFERENCE TO RELATED APPLICATIONS

This application is a continuation of U.S. application Ser. No. 11/466,747 entitled "Roll Motion Damping Device for a Floating Body," filed on Aug. 23, 2006, which claims the benefit of U.S. Provisional Application No. 60/763,293, filed on Jan. 30, 2006. U.S. application Ser. No. 11/466,747 and U.S. Provisional Application No. 60/763,293 are commonly assigned with the present application and is hereby incorporated by reference for all purposes.

TECHNICAL FIELD

The embodiments described below relate generally to techniques for dampening roll motion induced on boats, ships, and other floating bodies/vessels by wave action.

BACKGROUND

Waves are a fact of life for all floating bodies/vessels. From ocean-going ships, barges, and floating oil platforms to freshwater boats and canoes, all floating vessels are impacted by waves. As a result, one of the main design characteristics for any floating vessel is stability. Stability is important not only because it affects the comfort of passengers and crew (by reducing the sensation of movement that can lead to motion-sickness, for example), but also because it affects safety. After all, in order to safely traverse a body of water, a floating vessel must be sufficiently stable so that it will not capsize when exposed to waves.

Waves can induce several different types of motion on a floating vessel. One of the most critical of such motions that should be accounted for when designing a floating vessel is roll. Roll is the tendency of a vessel to rotate back and forth, rocking from side to side about its longitudinal axis. Of all of the motions experienced by a floating vessel, roll has the most significant impact on stability; if waves impart too much rolling motion to a floating vessel, then the vessel may capsize.

Given the importance in overcoming wave-induced roll, floating vessel hull design has concentrated on techniques for resisting wave roll motion. Despite such design efforts, however, roll continues to be a critical problem that should be addressed in order to produce more effective floating vessels. Disclosed below are novel techniques and devices that can be used to dampen roll motion in floating vessels. These disclosed embodiments can be integrated into new floating vessel designs, or they may be retrofitted onto pre-existing vessels, added onto vessels in order to improve the way that such vessels handle adverse wave roll situations.

BRIEF SUMMARY

There are two primary ways in which roll motion may be resisted: inertial resistance and viscous drag resistance. Inertia describes a body's tendency to resist changes in its motion (or as generally described in science texts, inertia is the tendency of a body at rest to stay at rest and a body in motion to stay in motion in the same direction at the same velocity), and it is proportionate to the mass of the body at issue. So, one way to increase a floating vessel's resistance to roll is to increase the vessel's mass moment of inertia.

By increasing a floating vessel's effective mass, the vessel's mass moment of inertia can be increased. This would dampen the effect of rolling motion introduced by waves by using the vessel's own inertial tendency to resist a change in its motion. This innate tendency can be amplified by increasing the vessel's mass. But there can be negative side effects to permanently increasing a floating vessel's mass. For example, increased mass could require increases in power in order to propel the vessel, as well as additional construction costs.

The embodiments disclosed below do not directly increase the material mass of the floating vehicle itself, instead they employ sponsons, located on either side of the vessel, to temporarily increase the vessel's virtual mass in response to wave roll motion. A sponson is an outboard projection from the side of a floating vessel that traps a portion of the surrounding water, adding this additional water mass to the vessel's effective mass in order to increase the vessel's overall mass moment of inertia. So, by enclosing water within a sponson rigidly joined to a floating vessel, the vessel's inertial resistance to roll can be increased hydrodynamically. The value of the inertial resistance is the product of the added mass moment of inertia and the corresponding angular acceleration in roll. This term acts as an external moment exerted by the water and has a phase lag of 180 degrees in conjunction with the roll angular acceleration itself. In other words, it acts against the roll acceleration.

Another useful technique for resisting roll employs viscous drag forces to counteract the wave roll motion forces. Viscous drag is a phenomenon of resistance to motion through a fluid. It basically represents the sum of all hydrodynamic forces in the direction of the fluid flow, such that it acts to oppose object motion. The disclosed embodiments use this viscous drag resistance technique by positioning surfaces (such as baffles) to contact the water of the waves and vessel motion in such a way as to essentially divert some of the force of the flow into an opposing force that counteracts the wave roll motion. There are several methods in which to employ viscous drag to resist roll. A keel, or plate-like underwater fin, rigidly attached to the lower hull along the length of the vessel can add viscous drag that stabilizes the vessel by resisting the roll motion forces. As a wave induced flow moves across the keel, it causes a downward force that opposes the rolling wave motion on the vessel. Or baffles could be placed within each sponson in order to resist the roll motion of the waves, using a viscous drag force caused by the motion of the water within the sponson in response to a wave.

Both inertial resistance and viscous drag resistance each can play a role in dampening the rolling motion of waves on a vessel. It should be noted, however, that the viscous drag force tends to have a larger impact when roll resonant is a design issue. This is because the inertial resistance is linearly proportional to the time derivative of wave induced fluid velocity, while the viscous drag resistance increases with the square of the relative velocity between the vessel motion and the waves. Consequently, increasing viscous drag resistance is a primary design objective.

The embodiments disclosed below can use either or both of these general techniques to resist roll. Often, inertial resistance and viscous drag resistance can be used in conjunction, maximizing a floating vessel's overall resistance to roll. When a keel is called for by a particular design, the disclosed embodiments tend to make use of a wing keel, rather than a conventional bilge keel, which is attached to the hull. A wing keel is an underwater fin that has an angled foil that projects out more towards the horizontal plane. A wing keel can be used in conjunction with a sponson, while a conventional bilge keel cannot. In fact, a wing keel can improve the effectiveness of a sponson and baffles in resisting roll motion. And the wing keel itself provides greater resistance to roll motion than does the conventional bilge keel. The disclosed embodiments also demonstrate the effectiveness of using multiple baffles within each sponson. This practice can increase the inertial resistance provided by the sponson, by trapping additional water within the sponson, as well as providing additional surfaces for viscous drag to counteract the roll motion.

These techniques each can operate independently to dampen the rolling effect of waves on a floating vessel, but their combined effect may be even more pronounced. The disclosed embodiments illustrate a synergistic approach to roll dampening, in which the wing keel can assist in increasing the effectiveness of both sponsons and baffles. So, the disclosed embodiments operate to resist wave induced roll motion in a floating vessel. These embodiments can be incorporated into newly designed vessels, or they may be added onto existing vessels to improve their stability characteristics. Additional details regarding the described embodiments are provided below, making specific reference to the figures.

BRIEF DESCRIPTION OF THE DRAWINGS

Reference is made to the following drawings of the disclosed embodiments.

DETAILED DESCRIPTION

Figure 1:
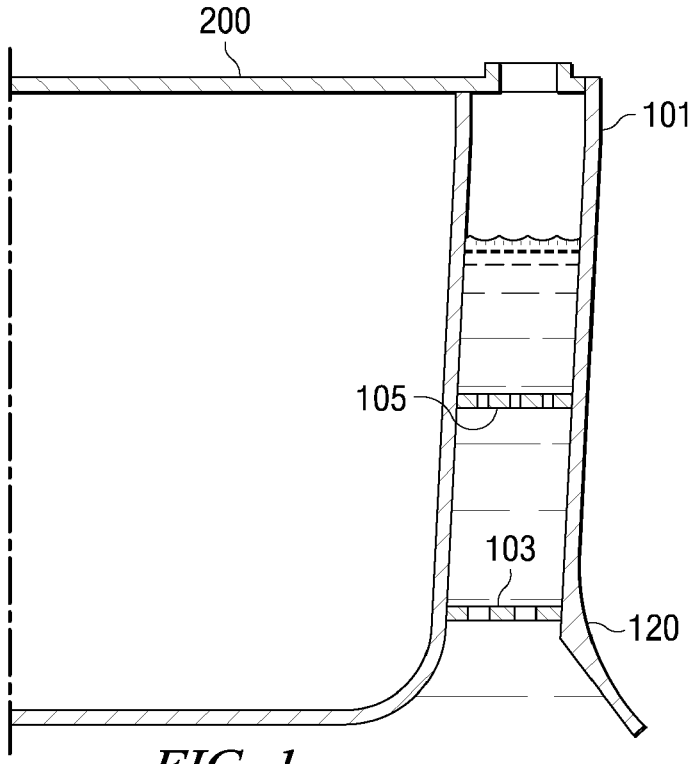
FIG. 1 is a cross section profile view, illustrating half of a floating vessel with a sponson affixed to the side of the vessel, having baffles and a wing keel.
Figure 4:
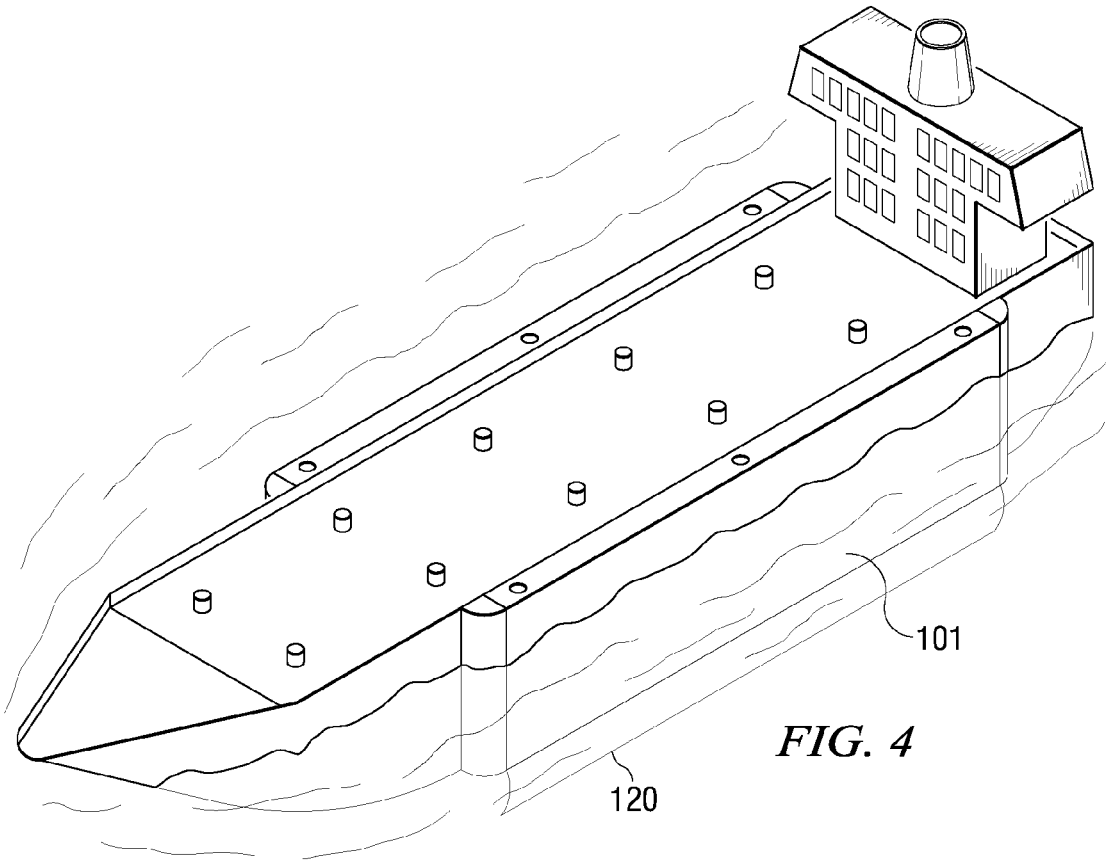
FIG. 4 is a perspective view of a vessel with outboard sponson.

The disclosed embodiment shown in FIG. 1 represents half of a cross-section of a floating vessel 200 with both a sponson 101, including multiple internal baffles 103 and 105, and a wing keel 120. In operation, the other side of the floating vessel 200 would typically be a mirror image of that shown in FIG. 1, so that any anti-roll devices would operate in a complementary fashion on both sides of the vessel 200. In FIG. 1, sponson 101 is rigidly attached to the hull of the floating vessel 200. The sponson 101 is a relatively thin (with respect to the cross-sectional width of the vessel 200) projection that extends upward from the bottom of the vessel 200 to above the waterline. The sponson 101 is open on the bottom, allowing water to enter into the cavity formed by the sponson 101 next to the vessel's hull 200, and in the embodiment illustrated in FIG. 1, the top of the sponson 101 opens to atmosphere. In this particular embodiment, the sponson 101 would typically run approximately the entire length of the vessel 200, as shown in the illustrative example of FIG. 4.

When the vessel 200 is floating in a body of water, water enters the sponson 101 through the bottom opening and equalizes within the cavity of the sponson. In this way, the sponson 101 holds a certain mass of water in attachment to the vessel 200, essentially acting to increase the effective mass of the vessel. This increase in effective mass serves to increase the vessel's 200 inertial resistance to roll by increasing the vessel's mass moment of inertia, such that the vessel's innate resistance acts to dampen wave roll motion.

When the wave period coincides with the roll natural period, a resonant phenomenon occurs. In this case, an increase of the effective mass moment of inertia of the vessel due to the presence of the sponson(s) would lead to an increase of the natural period, thereby allowing the roll resonance to be de-tuned. Once de-tuned, the energy absorption from the waves would be significantly reduced. The resulting effect is a net reduction of the roll motion amplitude.

The size of the cavity defined by the sponson 101 may vary. In one embodiment, the height of the sponson 101 is such that, at a minimum, it extends from near the bottom of the vessel 200 to above the waterline. The length of the sponson 101, while variable, typically approximates the length of the vessel 200. The cross-sectional width of each sponson 101 can vary according to need; the more inertial resistance desired to counteract the roll motion of the waves, the larger mass of water the sponson should encompass.

The disclosed embodiment of FIG. 1 also includes a wing keel 120 located on the exterior surface of the sponson 101 near the bottom opening of the sponson. The wing keel 120 typically runs the length of the sponson 101, and angles outward as it extends away from the sponson (as may be seen in the illustrative example shown in FIG. 1). Thus, the sponson 101 with the wing keel 120 has a bottom opening that flares outward. In this design, the wing keel 120 serves a channeling function because of its shape, essentially acting as an enlarged inlet that scoops water up into the sponson 101. In doing so, the wing keel improves the effectiveness of the sponson 101, as well as that of any baffles located within the sponson 101.

In addition to channeling water into the sponson 101, the wing keel 120 serves as a resistive surface for roll motion. It adds to the vessel's 200 mass moment of inertia hydrodynamically, as well as providing a viscous drag effect that resists rolling motion. As a wave moves towards the vessel 200, it crosses over the wing keel 120. The force of the wave pushing against the wing keel creates a downward force upon the vessel 200 in resistance to the wave rolling motion. Thus, the hydrodynamic effect of the wing keel 120 is to add to the effective mass moment of inertia of the vessel 200. Simultaneously, the wing keel 120 serves as a surface that experiences drag. So, the wing keel 120 operates to resist wave roll motion in two separate ways, one based on energy dissipation as a result of viscous damping, and the other based on inertia resistance as a result of the added mass moment of inertia.

Figure 3A:
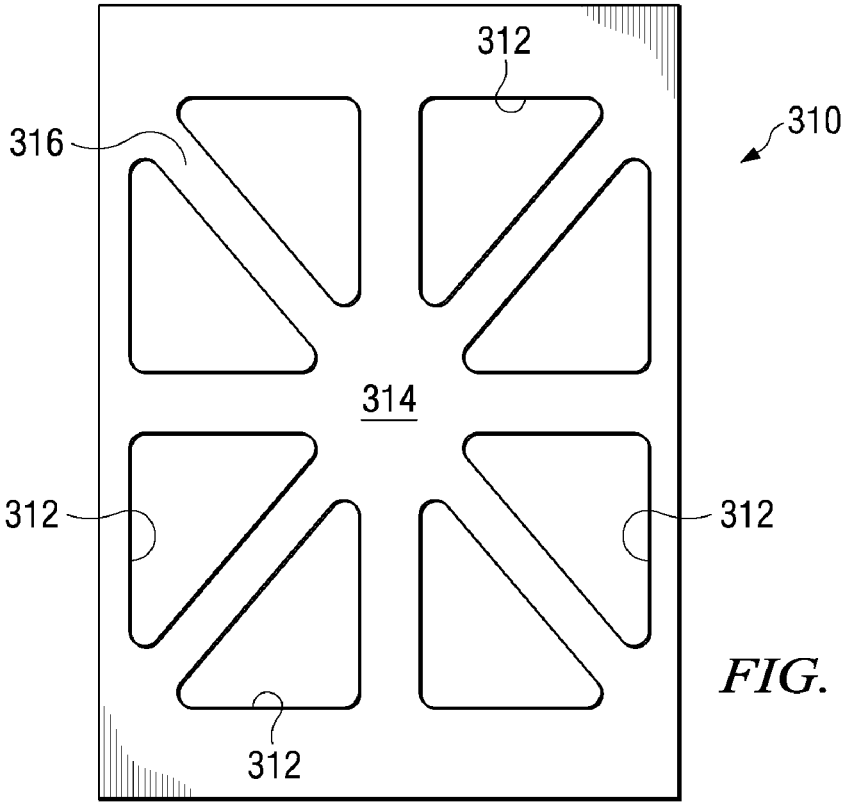
FIGS. 3A-3B illustrate exemplary baffle designs.
Figure 3B:
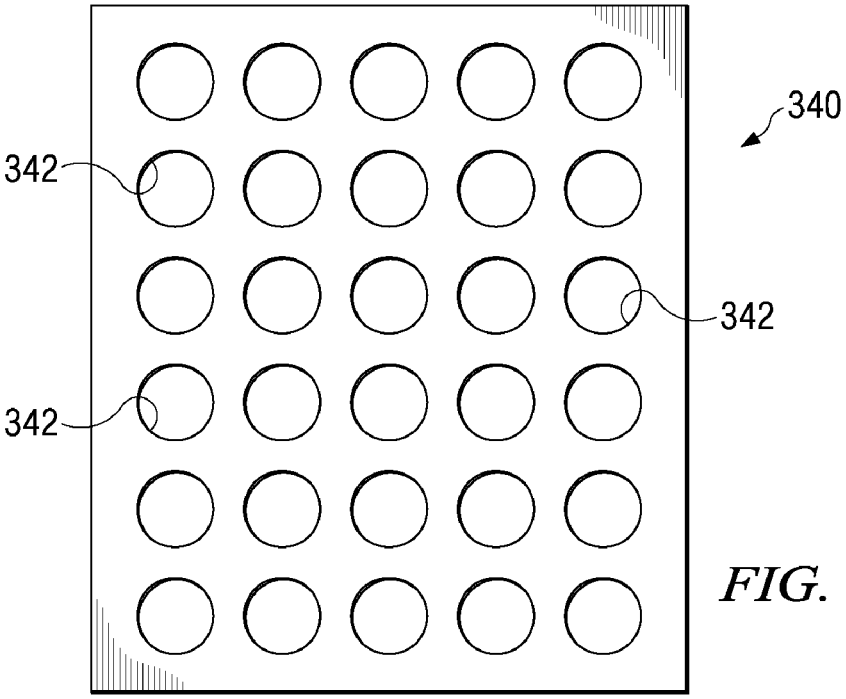

The embodiment of FIG. 1 also shows how baffles located within the sponson 101 can provide viscous drag resistance to roll motion. In disclosed embodiments, each baffle is a primarily horizontally oriented plate extending across the cavity within the sponson 101, with an opening area(s) that allows fluid flow through the baffle and thereby within the sponson. In practice, baffles include a plurality of panels (such as those depicted in FIGS. 3A and 3B) disposed adjacent to one another in a longitudinal direction. In some embodiments, the baffles run the entire length of the sponson. Baffles according to the present disclosure may take on a variety of shapes and configurations. For example, the baffles may be formed to include pores, small openings, large openings, slits and/or any other configuration that directs the flow of fluid in a desired manner. FIG. 3 depicts exemplary baffle panel designs. FIG. 1 illustrates a sponson 101 with a pair of baffles. Baffle 103 is located relatively near the bottom opening of the sponson 101, and controls initial water flow into and out of the sponson. Baffle 105 restricts water flow within the sponson 101, thereby increasing viscous drag and helping the sponson trap additional water mass for inertial resistance. Baffles serve to restrict water flow within the sponson 101, thereby helping to make the sponson more effective in terms of adding inertial resistance, while also providing viscous drag resistance to roll. The baffles within the sponson 101 help trap water mass within the sponson, so that the sponson functions more effectively. The baffles also serve as surfaces that provide viscous drag resistance when the water within the sponson 101 contacts the baffle plates.

A single baffle 103, typically located near the bottom opening of the sponson 101, both improves sponson performance and provides viscous drag, but multiple baffles may further improve effectiveness on both counts. The embodiment of FIG. 1 illustrates multiple baffles. Baffle 103 is located near the bottom opening of the sponson 101. One or more internal baffles 105 are located further up within the sponson 101, below the waterline. The presence of multiple baffles, such as baffle 103 near the bottom opening and internal baffle 105 below the waterline, can increase the viscous damping effect by providing additional resistive surfaces with which water flow may make contact. As water flows within the sponson 101 in response to the wave action outside the sponson, it comes into contact with the restrictive baffles 103 and 105. The viscous drag that results can provide a force moment that counteracts the rolling motion introduced by the waves. Furthermore, multiple baffles, such as 103 and 105 in FIG. 1, act to trap more water within the sponson 101. In this way, the baffles 103 and 105 enable the sponson 101 to more effectively add to the vessel's 200 inertial resistance.

While multiple baffles, such as baffles 103 and 105 in FIG. 1, can increase the resistance against roll, in order for multiple baffles to be employed most effectively, the baffles tend to be vertically spaced at least a minimum distance apart. Typically, the spacing between baffles should be approximately the width of the sponson 101 that the baffles are located within. In FIG. 1, this spacing of baffles 103 and 105 provides the proper hydrodynamic flow within the sponson 101 for effective viscous drag resistance. If the baffles were spaced more closely, there might be a shielding effect as water flowed between baffles, which could reduce the effectiveness of successive baffles. Thus, the number of baffles located within the sponson 101 should typically be set to an integer that is less than the value of the waterline height of the sponson 101 divided by the width of the sponson 101 at the bottom opening.

The effectiveness of the baffles can also vary depending upon geometry, with the size and shape of the opening(s) in the baffle plate playing the primary role. By way of example, the baffle design 310 in FIG. 3A is configured to effectively resist in-plane loads. In addition, baffle design may trap water mass and create drag force. Generally, baffle design 310 comprises a planar sheet of material with a plurality of apertures 312 through which water may flow. The plurality of apertures 312 are substantially triangular in shape, and surround a central point 314 in the planar sheet of the baffle. Each substantially triangular aperture 312 is oriented so that it is substantially a mirror image of its neighboring apertures 312 (with the strip 316 of the planar sheet between triangular apertures serving as the reflecting line). Thus, the strips 316 of the planar sheet between the plurality of apertures form a substantially asterisk shape, with connecting strips 316 extending outward from the central point 314 to link a border of sheet material surrounding the apertures 312. Because of its features, baffle design 310 would generally be used as the lower baffle 103, located in proximity to the bottom opening of the sponson 101.

The baffle plate 340 in FIG. 3B, on the other hand, is configured to maximize drag (and thereby damping force). Generally baffle 340 of FIG. 3B also comprises a planar sheet of material with a plurality of apertures 342 through which water may flow. In baffle design 340, however, the apertures 342 are substantially circular in shape and are substantially arranged in a series of rows. All of these apertures 342 are approximately the same size in this embodiment. Generally, each aperture 342 in a row would be spaced apart less than the diameter of an aperture, and each row would be spaced apart less than the diameter of an aperture. The drag characteristics of baffle design 340 may be adjusted by changing the size and spacing of the apertures 342. Because of its features, baffle design 340 would generally be used as an upper, internal baffle 105. One embodiment would utilize baffle design 310 as the lower baffle 103 (at the bottom opening of the sponson 101), while baffle design 340 would be used for internal baffles 105. Based on specific vessel needs, however, either disclosed baffle design may be used alone or in conjunction with another baffle design, either as an internal baffle or as a baffle at the bottom opening of a sponson 101. Likewise, such baffle designs are not limited to use within a sponson 101. The disclosed baffle designs are merely illustrative, and a wide array of baffle designs may be effective within the sponson 101. A person skilled in the field will appreciate such alternative baffle designs, all of which are intended to be included within the scope of this invention.

In the embodiment shown in FIG. 1, the wing keel 120 works in a complementary fashion with the sponson 101 and the baffles 103 and 105. The channeling function of the wing keel 120 scoops water into the sponson 101, increasing the water flow rate into the sponson. Essentially, the wing keel 120 provides a larger inlet for the bottom opening of the sponson 101, increasing the flow volume in proportion to the increase in the size of the bottom opening of the sponson due to the flaring wing keel 120. This increase in the flow rate makes the sponson 101 more effective, by allowing the trapped mass of water within the sponson 101 to increase more quickly. This makes the changing inertial resistance more responsive to the wave action, providing a more effective counteracting resistance to the roll motion of the waves. In addition, the increase in the water flow rate due to the wing keel 120 allows the baffles 103 and 105 to function more effectively in providing viscous damping. Since the amount of viscous damping provided by baffles 103 and 105 depends on the rate change of the volume of water (which is equal to the flow velocity times the opening area) flowing through the sponson 101, the wing keel 120 indirectly increases the viscous drag force provided by the baffles 103 and 105 in resistance to the roll motion of the waves.

The described embodiment of the wing keel 120 shown in FIG. 1 provides advantages over a conventional bilge keel. The first advantage is the ability of the wing keel 120 to operate in conjunction with a sponson 101, due to its shape and configuration. A conventional bilge keel cannot operate with a sponson 101, since its shape would act to block the bottom opening of the sponson 101. The flaring shape of the wing keel 120, by contrast, leaves the bottom opening of the sponson 101 unobstructed, and actually acts to direct water flow into the sponson. Further, the wing keel 120 provides greater hydrodynamic resistance than would a conventional bilge keel, since its flared shape means that the distance between the wing keel 120 and the roll center of the floating vessel 200 is maximized. The wing keel also provides a greater viscous drag force (in comparison to a bilge keel) due to its flared shape. By way of example, a ten percent increase in outboard distance (due to flaring) would lead to a net increase in the viscous drag damping moment of thirty-three percent over a conventional bilge keel. So, the wing keel 120 provides stability advantages of its own, as well as working in conjunction with sponsons 101 and baffles 103 and 105 to stabilize a floating vessel against rolling motion.

Figure 2:
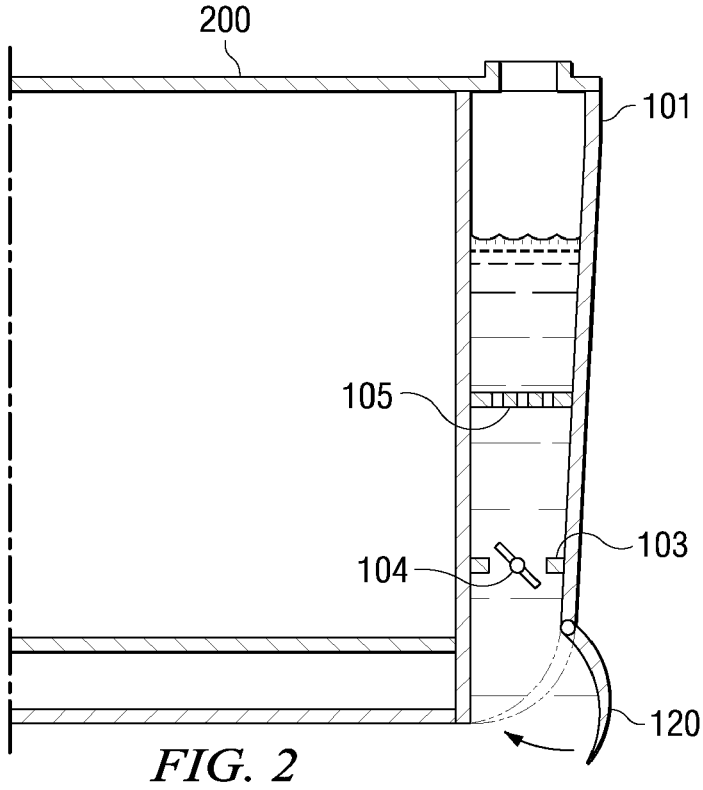
FIG. 2 is a cross section profile view, illustrating half of a floating vessel with an integrated sponson, having baffles and a hinged wing keel capable of closing off the bottom of the sponson.

FIG. 2 illustrates an alternative embodiment of the present disclosure. In particular, the embodiment of FIG. 2 shows a vessel 120 with an integrated sponson 101. Located within the sponson are two baffles, 103 and 105. Located at the bottom opening of the sponson 101 is a hinged wing keel 120. This hinged wing keel 120 can pivot between an open position, in which the hinged wing keel 120 angles outward as is described above for a fixed wing keel 120, and a closed position, in which the wing keel 120 seals off the sponson 101 by contacting the bottom of the vessel 200 in order to block water flow into the sponson 101. The disclosed embodiment of FIG. 2 also shows a baffle 103 with a flow control device, that can alter the size of the opening within the baffle 103. By opening or closing the baffle 103, the flow of water within the sponson may be altered as needed.

In practice, the embodiment of FIG. 2 illustrates several different optional features, all of which could be used alone or in some combination with the more typical features described above for FIG. 1 (or the other optional features shown in FIG. 2). For the design of certain types of vessels, it may be unnecessary to use a roll damping device in a continuous manner; roll damping might only be useful for a specific combination of the wave period, wave heading, and sea states. In such a circumstance, the design of the wing keel 120 could be modified such that it could be opened or closed mechanically using a hinge device. It is to be contemplated that the hinged wing keel of FIG. 2 could take on a variety of configurations.

The hinged wing keel 120 of FIG. 2 allows the vessel 200 to operate as if it has sponsons 101 for roll motion reduction, or as if it does not have sponsons 101. When the wing keel 120 is pivotally opened, the sponson 101 acts to trap water, adding to the vessel's inertial resistance to wave roll motion. By pivotally closing the hinged wing keel 120, however, the vessel 200 can operate as if it had no sponson 101. This allows the roll motion characteristics of the vessel to be altered, based upon the specific conditions of operation. For instance, the hinged wing keel 120 might be closed when the vessel 200 was cruising on open water without significant wave action, in order to reduce the drag experienced by the vessel 200. Then, if the vessel encountered increased wave action and began to experience roll, the hinged wing keel 120 could be opened, allowing the sponsons 101 to operate to aid in stabilizing the vessel 200.

The roll resistance/damping characteristics of the embodiment shown in FIG. 2 could further be altered by using a flow control device 104 to open or close baffle 103. By altering the effective opening area(s) in baffle 103, the viscous drag resistance to wave roll may be dynamically adjusted to suit the situation.

In the embodiment shown in FIGS. 1 and 2, the sponson design creates added moment of inertia and viscous damping not only for roll motion but also for pitch and heave motions as well. When the vessel encounters incoming waves head-on, or with an oblique angle, the sponson provides the additional benefits of dampening the pitch and heave motions based on the same principles (viscous damping and inertial resistance) as described above for the dampening of the roll motion.

While various embodiments in accordance with the principles disclosed herein have been described above, it should be understood that they have been presented by way of example only, and not limitation. For example, a duct may be used to connect the sponsons disposed on either side of the hull. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. Likewise, any mention of "vessel" or "floating vessel" is intended to include any and all floating bodies, and should not be construed in a limiting manner. In all instances, the scope of such claims shall be considered on their own merits in light of this disclosure, but should not be constrained by the headings set forth herein.

What I claim is:

1. A floating vessel comprising a roll motion damping device, the roll motion damping device comprising:

a sponson located alongside a floating vessel and rigidly attached to the hull of the floating vessel, the sponson comprising an exterior surface positioned away from the floating vessel, thereby defining a cavity within the sponson substantially open along its bottom, wherein the sponson extends from below a waterline of the floating vessel to above the waterline;

at least one baffle extending substantially horizontally with and below the waterline, and within and across the cavity defined by the sponson and spaced above the bottom opening of the sponson, the baffle being a substantially planar sheet capable of inducing a viscous drag force and trapping water mass within the cavity defined by the sponson; and a wing keel on the sponson, the wing keel being capable of directing water through the at least one baffle and into the cavity defined by the sponson;

wherein the water directed by the wing keel and trapped within the sponson is operable to temporarily increase the inertial resistance and viscous drag resistance of the floating vessel in response to a wave roll motion.

2. A floating vessel according to claim 1, wherein the at least one baffle extends substantially horizontally from the hull to the exterior surface.

3. A floating vessel according to claim 1, wherein the at least one baffle comprises a plurality of baffles.

4. A floating vessel according to claim 1, wherein the wing keel is mounted on the exterior surface of the sponson and disposed at a lower portion of the sponson, the wing keel projecting outward from a vertical plane defined by the exterior surface of the sponson.

5. A floating vessel according to claim 1, wherein the wing keel is pivotally connected to the bottom opening of the sponson, permitting movement of the wing keel between at least two positions such that said bottom opening of the sponson may be opened or closed.

6. A floating vessel according to claim 1, wherein the baffle comprises a planar sheet having a plurality of apertures.

7. A floating vessel according to claim 6, wherein each of the plurality of apertures are triangular in shape.

8. A floating vessel according to claim 6, wherein each of the plurality of apertures are circular in shape.

9. A floating vessel according to claim 1, wherein the at least one baffle is capable of being opened and closed in order to alter water flow within the sponson.

10. A floating vessel according to claim 3, wherein at least one of the plurality of baffles is capable of being opened and closed in order to alter water flow within the sponson.

11. A floating vessel according to claim 1 further comprising a second sponson, wherein one sponson is disposed on either side of the floating vessel.

12. A method for reducing roll motion in a floating vessel, the method comprising:

providing a roll motion damping device comprising a sponson located alongside a floating vessel and rigidly attached to the hull of the floating vessel, the sponson comprising an exterior surface positioned away from the floating vessel, thereby defining a cavity within the sponson substantially open along its bottom, wherein the sponson extends from below a waterline of the floating vessel to above the waterline;

disposing at least one baffle substantially horizontally with and below the waterline, and within and across the cavity defined by the sponson and spaced above the bottom opening of the sponson, the baffle being a substantially planar sheet capable of inducing a viscous drag force and trapping water mass within the cavity defined by the sponson; and disposing a wing keel on the sponson, the wing keel being capable of directing water through the at least one baffle and into the cavity defined by the sponson;

wherein the water directed by the wing keel and trapped within the sponson is operable to temporarily increase the inertial resistance and viscous drag resistance of the floating vessel in response to a wave roll motion.

13. A method according to claim 12, wherein the at least one baffle comprises a plurality of baffles, the method further comprising altering the flow of water in the sponson by opening and closing at least one of the plurality of baffles.

14. A method according to claim 12, further comprising disposing a wing keel on the exterior surface of the sponson and disposed at a lower portion of the sponson, the wing keel projecting outward from a vertical plane defined by the exterior surface of the sponson.

15. A method according to claim 12, wherein disposing a wing keel further comprises pivotally connecting the wing keel to the bottom opening of the sponson, and altering the flow of water in the sponson by opening and closing the wing keel.

16. A floating vessel comprising a roll motion damping device, the roll motion damping device comprising:

a pair of sponsons located on either side of a floating vessel and rigidly attached to the hull of the floating vessel, the sponsons each comprising an exterior surface positioned away from the floating vessel, thereby defining corresponding cavities within the sponson substantially open along their bottoms, wherein the sponsons extend from below a waterline of the floating vessel to above the waterline;

at least one baffle extending substantially horizontally with and below the waterline, and within and across each corresponding cavity defined by the sponsons and spaced above the bottom openings of the sponsons, the baffles being substantially planar sheets having apertures therethrough configured to induce a viscous drag force and trapping water mass within the cavities defined by the sponsons; and a wing keel on each of the sponsons, the wing keels being capable of directing water through the at least one baffle and into the cavities defined by the sponsons;

wherein the water directed by the wing keels and trapped within the sponsons is operable to temporarily increase the inertial resistance and viscous drag resistance of the floating vessel in response to a wave roll motion.

17. A floating vessel according to claim 16, wherein the wing keels are mounted on the exterior surface of each of the sponsons and disposed at lower portions of each corresponding sponson, the wing keels projecting outward from vertical planes defined by the exterior surfaces of the sponsons.

18. A floating vessel according to claim 16, wherein the wing keels are pivotally connected to the bottom openings of the sponsons, permitting movement of the wing keels between at least two positions such that said bottom openings of the sponsons may be opened or closed.

19. A floating vessel according to claim 16, wherein each of the plurality of apertures are triangular or circular in shape.

20. A floating vessel according to claim 16, wherein the baffles are capable of being opened and closed in order to alter water flow within the sponsons.

* * * * *